US006253446B1

(12) United States Patent
Caddock, Jr.

(10) Patent No.: US 6,253,446 B1
(45) Date of Patent: Jul. 3, 2001

(54) FAULT CURRENT FUSING RESISTOR AND METHOD

(76) Inventor: Richard E. Caddock, Jr., 300 Thora Cir., Winchester, OR (US) 97495

( * ) Notice: Subject to any disclaimer, the term of this patent is extended or adjusted under 35 U.S.C. 154(b) by 0 days.

(21) Appl. No.: 09/237,977

(22) Filed: Jan. 25, 1999

Related U.S. Application Data

(60) Division of application No. 08/599,813, filed on Feb. 12, 1996, now Pat. No. 5,914,648, which is a continuation-in-part of application No. 08/400,046, filed on Mar. 7, 1995, now abandoned.

(51) Int. Cl.[7] ..... H01O 17/00

(52) U.S. Cl. ..... 29/610.1; 338/309; 338/308; 337/159

(58) Field of Search ..... 29/610.1, 621, 29/623, 411; 337/252, 186, 227, 228, 232, 297

(56) References Cited

U.S. PATENT DOCUMENTS

| | | | | |
|---|---|---|---|---|
| 3,401,452 | | 9/1968 | Ragan . | |
| 3,555,365 | | 1/1971 | Forlani et al. . | |
| 3,978,443 | * | 8/1976 | Dennis et al. | 338/297 |
| 4,093,932 | | 6/1978 | Kozacka . | |
| 4,626,818 | | 12/1986 | Hilgers . | |
| 5,027,101 | * | 6/1991 | Morril, Jr. | 337/297 |
| 5,032,817 | | 7/1991 | Morril, Jr. et al. . | |
| 5,097,246 | | 3/1992 | Cook et al. . | |
| 5,140,295 | | 8/1992 | Vermot-Gaud et al. . | |
| 5,166,656 | | 11/1992 | Badihi et al. . | |
| 5,168,416 | * | 12/1992 | Bailey et al. | 361/31 |
| 5,228,188 | * | 7/1993 | Badihi et al. | 29/623 |
| 5,252,944 | | 10/1993 | Caddock, Jr. . | |
| 5,254,969 | | 10/1993 | Caddock, Jr. . | |
| 5,291,178 | | 3/1994 | Strief et al. . | |
| 5,296,833 | | 3/1994 | Breen et al. . | |
| 5,304,977 | | 4/1994 | Caddock et al. . | |
| 5,361,300 | | 11/1994 | Caddock, Jr. . | |
| 5,363,082 | | 11/1994 | Gurevich . | |
| 5,440,802 | | 8/1995 | Whitney et al. . | |
| 5,453,726 | | 9/1995 | Montgomery . | |
| 5,479,147 | | 12/1995 | Montgomery . | |
| 5,481,242 | | 1/1996 | Caddock, Jr. . | |
| 5,581,227 | | 12/1996 | Drekmeier . | |
| 5,594,407 | | 1/1997 | Caddock, Jr. . | |
| 5,621,378 | | 4/1997 | Caddock, Jr. et al. . | |
| 5,633,620 | | 5/1997 | Doerrwaecther . | |

FOREIGN PATENT DOCUMENTS

| | | |
|---|---|---|
| 2944605A1 | 11/1979 | (DE) . |
| 3245629A1 | 12/1982 | (DE) . |
| 41 14 495 A1 | 7/1991 | (DE) . |
| 0581 428 A1 | 2/1994 | (EP) . |
| 0626 714 A1 | 11/1994 | (EP) . |
| 066560 A2 | 12/1994 | (EP) . |
| 2225455A | 11/1992 | (GB) . |
| 2175574 | 7/1990 | (JP) . |
| 4902480 | 11/1992 | (JP) . |
| 5144368 | 6/1993 | (JP) . |
| 5274994 | 10/1993 | (JP) . |
| 1749943 A1 | 7/1990 | (SU) . |

* cited by examiner

*Primary Examiner*—Lee Young
*Assistant Examiner*—Sean Smith
(74) *Attorney, Agent, or Firm*—Oppenheimer Wolff & Donnelly, LLP

(57) ABSTRACT

A fault current fusing resistor, comprising a substrate on which there is a line of resistive film formed of metal and glass in a conductive film, which line is closely confined by containing and sealing substances to prevent venting of vapor from the line during the fusing caused by an electrical fault condition.

12 Claims, 4 Drawing Sheets

FIG. 7.
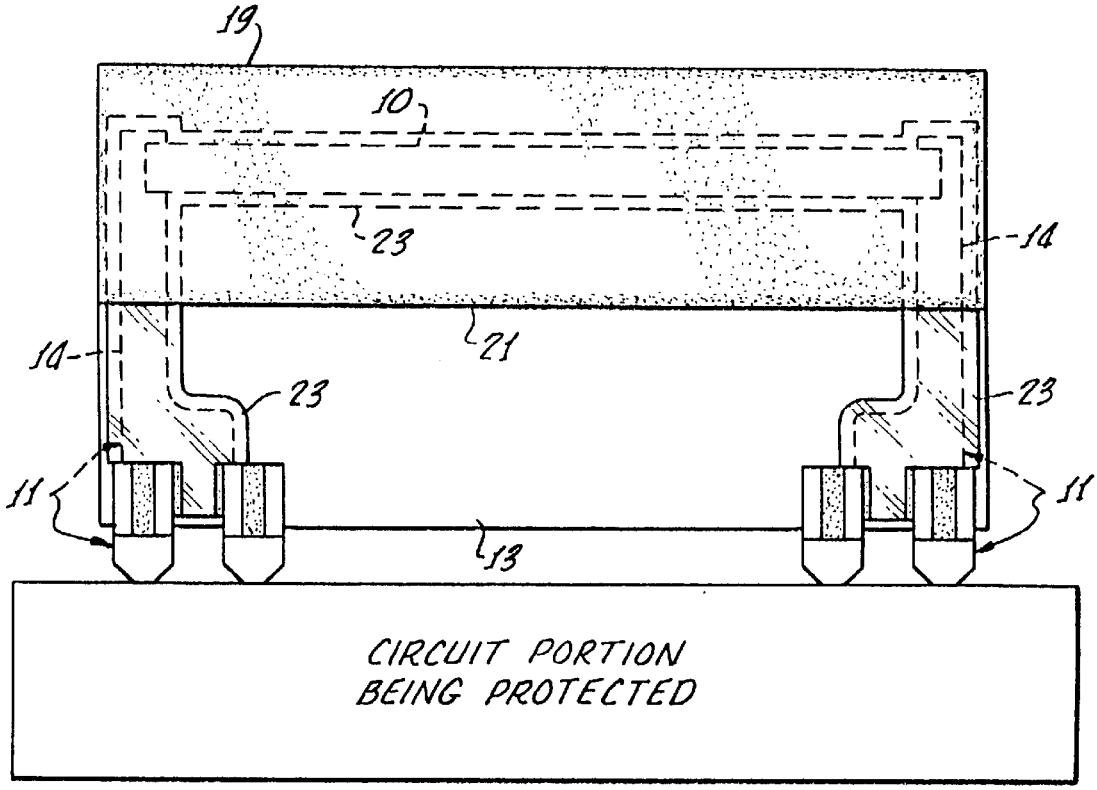
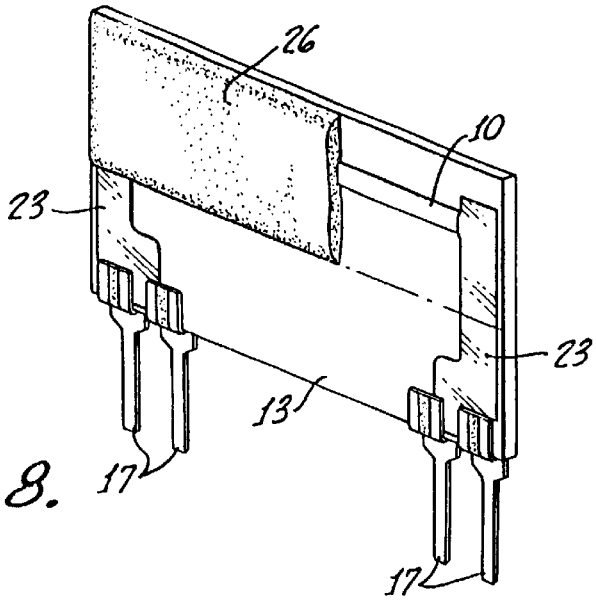
FIG. 8.

FAULT CURRENT FUSING RESISTOR AND METHOD

CROSS REFERENCE TO RELATED APPLICATION

This is a divisional of a second CPA applications filed Jul. 29, 1998, which issued on Jun. 22, 1999, as U.S. Pat. No. 5,914,648, which is a CPA of a first CPA application, filed May 14, 1998, which is a CPA of application Ser. No. 08/599,813, filed Feb. 12, 1996, which is a continuation-in-part of application Ser. No. 08/400,046, filed Mar. 7, 1995, now abandoned.

BACKGROUND OF THE INVENTION

There is, in a number of industries and applications, a major need for a fault current fusing resistor that is very fast opening for relatively high currents and high AC and DC voltages. There is an even greater need for such a fault current fusing resistor that is inexpensive to manufacture and small in size, and that is characterized by a high degree of safety.

To state one example, there are power system applications where power-semiconductors (transistors, thyristors, SCRs etc.) are used in circuits which manage large currents at relatively high DC voltages. An illustration is the power drivers for motors such as are used on electric trains. The power-semiconductors associated with the control circuits or drive circuits occasionally short internally, which can cause the portion of the circuit that is in the short circuit path caused by the shorted power-semiconductor to be exposed suddenly to a very high fault current and fault voltage.

The preceding paragraph sets forth one example of a fault current condition, which is not a gradual or progressive current buildup to an excessive value, but instead a sudden large step or jump in current from normal to excessive. "Normal" is the current level present in the portion of the power-semiconductor circuit to be protected (potential short circuit path) against fault current during normal operation; it is a low current typically from a few milliamps to 2 amps. "Excessive" is what is present in the short circuit current path substantially immediately upon occurrence of the short, being the high fault current that is typically in excess of 15 amps, and more typically 50 amps to 500 amps or greater-with a voltage typically in excess of 125 volts up to 1,000 volts or higher.

It is badly needed to have an economical, fast-acting, fusing device that operates at those and other relatively high (excessive) fault currents and high voltages. Fast operation would effectively protect circuit board traces, and components, in the short circuit current path.

Insofar as applicant is presently informed, fault current fusing devices which operate at relatively high currents and that can interrupt at relatively high voltages are quite large, and/or expensive, and/or slow-acting, and/or have other disadvantages.

SUMMARY OF THE INVENTION

In accordance with the device and method of the invention, there is provided a fault current fusing resistor (FCFR) that operates very quickly when exposed to the described (and other) relatively high fault currents and relatively high fault AC/DC voltages. The device opens (clears) in a way that is controlled, contained, and nonexplosive, thus substantially safe, and that does not generate debris. There is substantially no uncontained arcing, or no arcing at all.

In accordance with a method of the invention, the stated article or device is placed in a power-semiconductor circuit, or the like, and operates for great periods of time with only the normal low current passing through it. However, upon sudden occurrence of a fault current, the step change in current flow results in the stated very fast cessation of flow of the fault current.

In accordance with a preferred embodiment of the device, a relatively low value elongate resistive element (not a wire) is sandwiched between a base and a lid, and sealed therebetween as by epoxy. The resistive element within the sealed device has such characteristics that upon occurrence of a fault current flow, such current flow very quickly ceases which includes the necessary interruption at the fault voltage.

In accordance with the method and article of the invention, metal, preferably mixed with glass in a conductive film, is employed in a novel manner producing startling results.

The preferred resistive element is a resistive film provided on the base (substrate), and the film has a relatively low resistance.

The resistive film has deposited there over an overglaze (or equivalent) film.

Terminals and traces are provided on the substrate for the resistive film. In one embodiment, the terminals and substrate and traces are so disposed and related as to insure against excessive heating of the terminals (and the related circuit board portion) during normal current conditions.

BRIEF DESCRIPTION OF THE DRAWINGS

FIG. 7 shows the combination of FCFR and circuit portion being protected, the latter being represented diagrammatically in block form;

FIG. 8 is an isometric view of another embodiment of the invention, portions being broken away;

DETAILED DESCRIPTION OF THE PREFERRED EMBODIMENT

Figure 1:
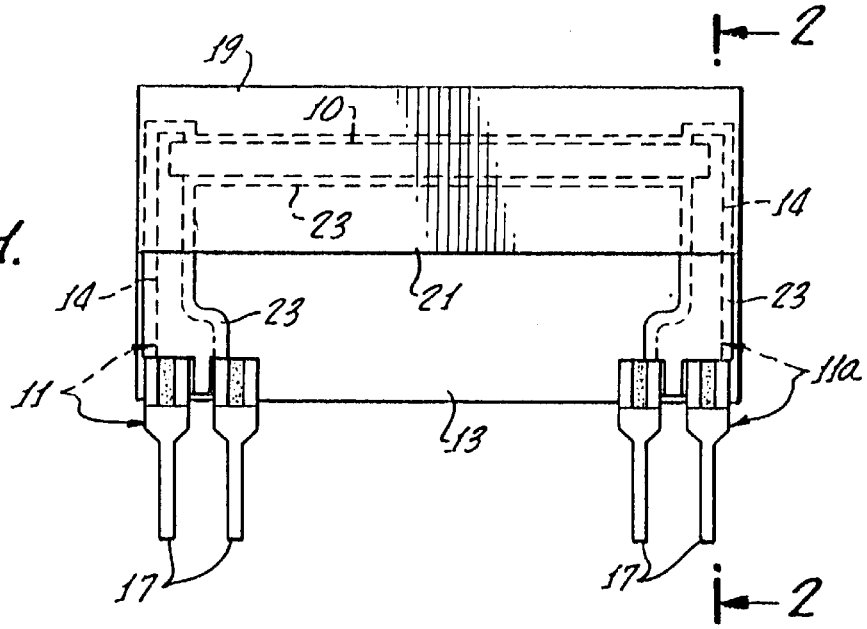
FIG. 1 is a greatly enlarged plan view of an FCFR embodying the present invention.
Figure 5:
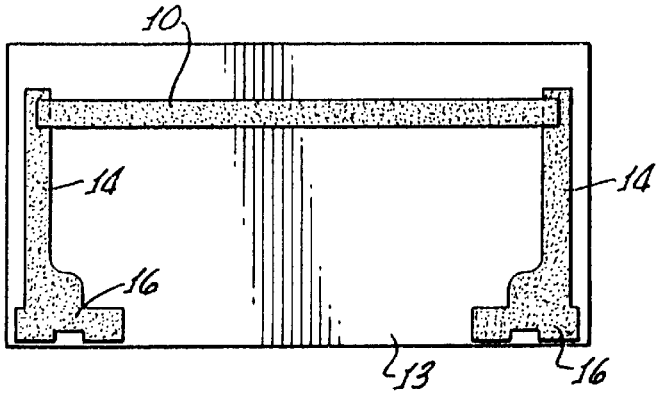
FIG. 5 shows the resistive film as applied to the substrate.
Figure 6:
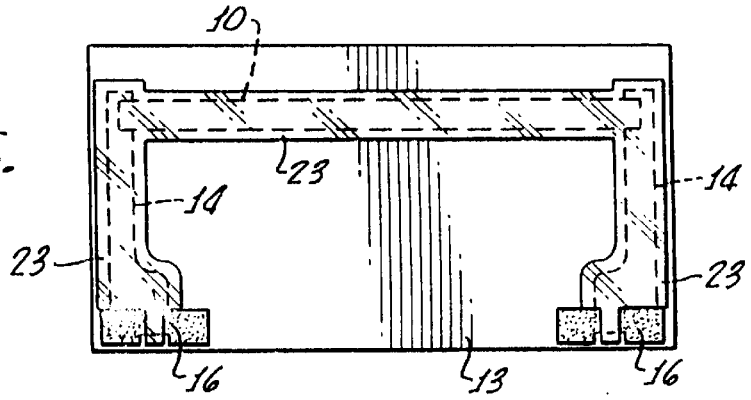
FIG. 6 shows the glass coating as applied over the films at all portions except terminal pad regions.
Figure 9:
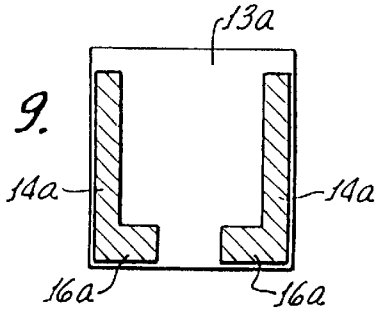
FIGS. 9–14, inclusive, are front elevational views of steps incident to the production of an additional embodiment.
Figure 10:
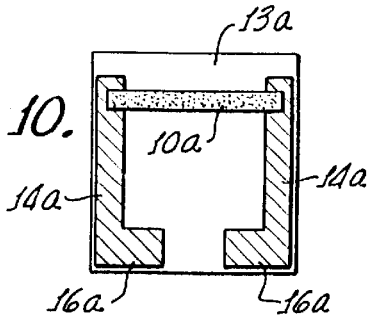
Figure 11:
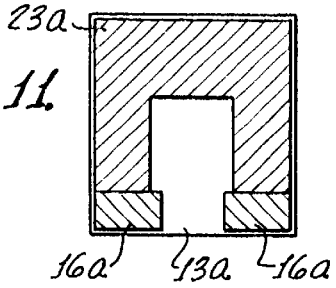
Figure 12:
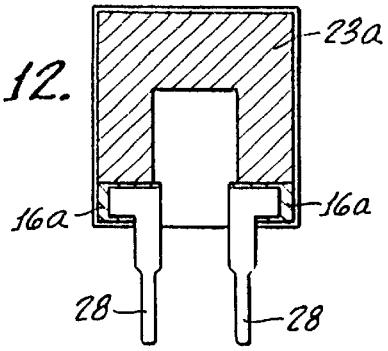

Referring particularly to FIGS. 1, 5 and 6, an elongate resistive element 10 is extended between terminal means 11, 11*a* (FIG. 1). The element 10 is contained and sealed-in by containing and sealing means 12 (FIG. 2) that are sufficiently strong to withstand the forces related to the heating and opening of the resistive element caused by fault current.

Resistive element 10 is preferably a screen-printed resistive thick-film composition on a base or substrate 13, the latter also forming part of the containing and sealing means described below. Alternatively, the resistive element 10 may be formed by vacuum deposition, sputtered deposition, "inkjet", or other similar means.

Preferably, the thick-film screen-printed element 10 is a palladium-silver composition. Preferably, the element 10 is screen-printed thin, using a 325 or 400 mesh screen. An example of the palladium-silver compositions that may be employed is "Ferro 850" series, sold by Ferro Corporation, Electronic Materials Division, Santa Barbara, Calif.

The composition and shape of the resistive element 10 are such that it has a relatively low resistance of usually under 30 ohms, preferably 10 ohms down to 1.0 or 0.5 ohm (or even somewhat lower). The resistance of resistive element 10 is not down to a small fraction of an ohm, for example, a few milliohms. The resistivity of the material forming the resistive element 10 is typically in the fractional ohms per square.

Relative to the length of the resistive line 10, this is made sufficiently long to withstand the applied voltage after the fault current has ceased, but sufficiently short to prevent the resistance from being excessively high and sufficiently short for proper operation. A line length of less than 1 inch is preferred. The lower the voltage rating of the device, the shorter the line length necessary for proper operation.

Relative to the width of the resistive line 10, the narrower lines are preferred insofar as operation during a fault is concerned. Thus, vis-a-vis FCFR action, a 0.01 inch line width is preferred over the 0.03 inch line width. However, during normal (pre-fault) operation, the wider (e.g. 0.03 inch) line spreads the power over a greater surface area and aids in heat dissipation. Thus, for example, (referring to resistive line 10) when normal power in the FCFR is a fraction of a watt, a narrower line such as the 0.01 inch wide line is preferred. When normal power is 1 watt or more, a wider line such as the 0.03 inch wide line is preferred.

The lower resistance values specified above-e.g., 1 ohm-require less power dissipation in the FCFR caused by normal mode lower level currents in (for example) the power-semiconductor circuit in which the FCFR is connected. Higher resistance values (such as 10 ohms) in the range specified in the preceding paragraph limit the magnitude of the fault current during the moment just before the FCFR opens.

Configurations that may be employed include arcuate and meandering, provided there is a shallow angle that avoids a small dimension between adjacent lines in the meandering pattern so that there will not be arcing between loops.

A straight line is preferred. The line may also be arcuate (as stated) or a wide angle that is preferably obtuse. The line (forming element 10) should progress forwardly (toward the opposite terminal) instead of doubling back. In any event, there may be no doubling back where different parts of the adjacent lines are so close together as to cause arcing.

The size of the actual resistive element 10, in a specific example given for purposes of illustration, not limitation, is about 0.680 inch long, having a width of 0.030 inch. The resistance of this specific example element is 10 ohms. In such specific example, the size of substrate 13 is 0.80 inch long by 0.50 inch high.

The line of resistive film, in the present example, is 0.0004 inch to 0.001 inch thick (fired thickness).

Proceeding next to a description of the terminal means 11 (FIG. 1), this may be a wide variety of terminals including (for example) terminals generally in line with the resistive element 10. It is not necessary that the terminals connect to the substrate 13 mechanically, but this is preferred for the present embodiment, which has solder attachment of the terminals.

Figure 3:
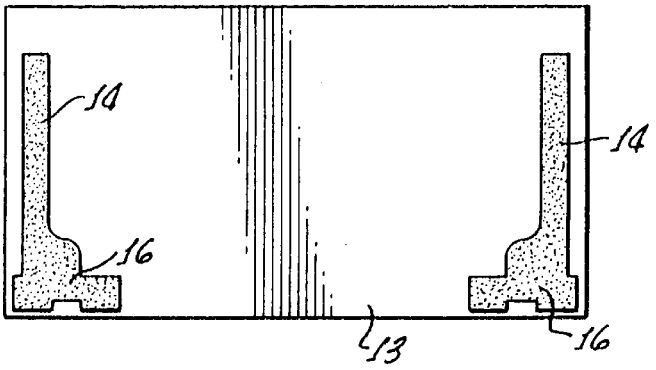
FIG. 3 shows one side of the substrate, with only the traces and terminal pads thereon.
Figure 4:
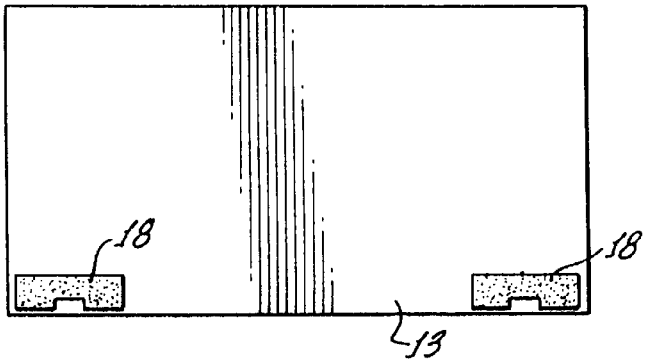
FIG. 4 is a rear view of FIGS. 3, 5 and 6, showing terminal pads.

Referring to FIG. 3, the illustrated screen-printed traces 14 and pass 16 form part of the terminal means 11 (FIG. 1), being located adjacent the ends of substrate 13 with the traces generally parallel to the ends of the substrate. Traces 14 and pads 16 are simultaneously screen-printed of a low resistivity material, preferably having a resistivity less than 5 milliohms per square. An example of this is DuPont 9770. Such DuPont 9770 is a platinum-silver composition. After the terminal (termination) traces and pads are screen-deposited, and before the resistive element 10 is deposited there over, the traces and pads are fired. Similarly, after the preferred screen-printed resistive element 10 is deposited, it is fired.

The terminal means in the illustrated example include jaw-type terminal pins 17 that clamp on pads 16, 18 and are soldered thereon.

The pins 17 are prevented from heating excessively, not only by the high conductivity of the traces 14 and pads 16, but also because the resistive element 10 is spaced away from the lower edge of the substrate 13, being relatively near the upper edge thereof. Thus, there is a substantial thermal gradient between the heat-generating resistive element 10 and the pin portions that are in the circuit board holes. The thermal gradient is increased by thinness of the substrate.

It is emphasized that various other configurations may be employed, for example, making the substrate much less high so that the pins are quite close to the resistive film. A smaller part is thereby achieved, as may be done, for example, when the resistance of the resistive element 10 is only (for example) about 1 ohm, and there is lower power dissipation caused by normal currents.

Proceeding to a detailed description of the containing and sealing means 12 (FIG. 2), the illustrated preferred such means comprises the substrate 13 which therefore (in the preferred form) serves not only for application of the films but as part of the containing and sealing means. It further comprises a lid 19 (FIGS. 1 and 2) that is preferably positioned with its top and side margins registered with the upper and vertical margins of substrate 13 and with its lower edge 21 spaced from resistive element 10. An exemplary material forming the substrate 13 and lid 19 is aluminum oxide.

Elements 13, 19 may each have a thickness of 0.030 inch. When the pressures are higher, each is made 0.040 inch thick. Even these relatively thin layers, formed of brittle aluminum oxide (for example), will contain the pressures resulting from large current flows through resistive element 10.

The containing and sealing means 12 further comprises sealing and connecting material 22. (FIG. 2) that fills the entire space between the facing surfaces of elements 13, 19. The preferred such material is epoxy adhesive. Because it fills the entire space, except that space occupied by the films, there is substantially no air between the elements 13, 19 (there may be very small air bubbles in the epoxy).

In the preferred embodiment, prior to application of the lid and the terminals, the resistive element 10 is covered with an overglaze (glass layer) 23. This glass layer is preferably screen-printed and is then fired. An exemplary material is DuPont 9137. There are preferably two passes during screen-printing, using a 200 mesh screen, fired after each pass at 550° C. to a highly glassy finish.

As shown best in FIG. 6, glass layer 23 is substantially larger than resistive element 10 so that it extends substantially beyond the sides and ends of the resistive element. As a result of fault operation, the resistive element 10 increases in width by typically less than 10% along each side. There may be no increase in width.

The ceramic substrate and lid, the epoxy, and (preferably) the glass layer cooperate to form an effective containing and sealing means 12 that (as above stated) prevent explosion of the FCFR and prevent blowouts. There is no debris after the fuse opens, and the product is characterized by a high degree of safety.

Figure 2:
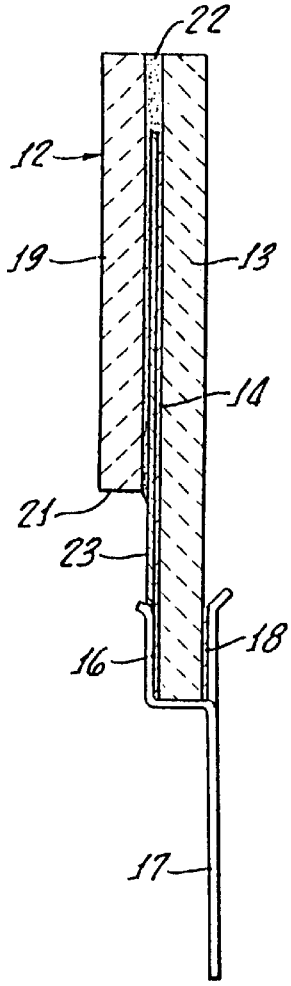
FIG. 2 is a further enlarged sectional view thereof, taken on line 2—2 of FIG. 1.

In another product that corresponds to the present one, except for size, the lower edge 21 of lid 19 is much lower than that illustrated in FIGS. 1 and 2, being adjacent the upper portions of the jaws of pins 17.

In performing the method of the invention, the present article or device (preferably the preferred form shown in the drawings and described in detail above) is mounted on a circuit board or otherwise connected in series relationship with the components or circuit board traces to be protected against short circuit current. Reference is made to FIG. 7. In the exemplary situation described at the beginning of this specification, this is a circuit for a power-semiconductor. Thus, in such exemplary situation, the present FCFR is connected in series with the potential short circuit current path of the power-semiconductor circuit.

Because of the presence of this invention, the harm and destruction are believed to be substantially completely prevented from occurring. Instead, what happens is that the fault current flowing through the resistive element causes breakdown of resistor conduction, which breakdown shuts off current in an extremely short time. There is a bright flash that is very clearly visible through the substrate 13. The distance between the upper ends of traces 14 is made sufficient, within the contained construction, to prevent resumption of current (restriking) despite continuation of the relatively high voltage that caused the device to open.

The above-specified specific-example article (10 ohms), at 1,000 volts DC and potentially 100 amps, shuts off the current in less than 200 microseconds-with the great majority of the current reduction occurring in the first 20 microseconds.

Because of the present invention, it is possible to build a control circuit with relatively little board copper trace. Stated otherwise, there can be a minimum trace dimension on the board of the control circuit, because the fusing operation of the present invention is so very quick. The quickness and completeness of the shut-off are astonishing.

When no glass (overglaze) is employed, the margins of the affected area resulting from fault current operation expand considerably compared as to what is the case when the glass is employed.

As above indicated, the present invention includes (in one of its aspects) the combination of a power-semiconductor (and the control circuit associated therewith) with the present FCFR. In accordance with one aspect of the present method, the FCFR in the combination stated in the preceding sentence safely opens at voltages in the range of 150 volts to 1,000 volts AC/DC.

The present device should not have any portion of the resistive element that is not contained. Thus, for example, there should be no unlidded resistive element portion exposed on the backside (exposed side) of the base or substrate and which is in circuit with the lidded resistive element on the frontside.

Additional Discussion of Method and Article

The present FCFR method and article are characterized by results that far exceed any of which applicant has ever heard. For example, a practical size of the present FCFR can operate at 2000 volts DC during a fault condition, and clear within 50 micro seconds. This occurs safely, with no breakage or other undesired consequence. It is only a flash of light that is an exteriorly visible consequence of the fault.

Applicant is unsure of much of the theory that relates to the surprising phenomena occurring in the present FCFR during a fault. There will now be indicated (1) those elements that applicant believes are important to achievement of the results stated in this specification, and (2) the condition of the resistive element after the fault has occurred.

The above-recited palladium-silver Ferro 850 contains palladium and silver and glass. These are present in powder (particle) form, in a suitable vehicle that is present during application to the substrate (as by screen printing) but is driven off by the firing. The palladium-silver Ferro 850 is an example of the distinctly preferred form of the present invention, namely certain metal and glass particles (powder) mixed with each other. After firing, the particles of metal are combined with glass in a conductive film. The majority of said film, by weight, is metal particles.

The second element indicated in the paragraph before last is close containment or encapsulation of the resistive element (such as 10). In the stated example, the substrate 13, the lid 19, the sealing and connecting material 22 and (in one form) overglaze 23 accomplish containment in a practical and economical manner. In the absence of containment, there would be an external "fire ball" during the high-current fault condition at high voltage. It is to be understood that effective close containment involves exclusion of substantial air and elimination of substantial voids; air is not desired at or near the resistive element (such as 10) because electric arcing is to be prevented to the maximum extent reasonable.

Another factor significant in achievement of optimum results is that the resistive line (such as 10) be quite thin. Thus, typically, a 325 or 400 mesh screen is used in the screen-printing operation. The film after firing is then about 0.0005 inch thick. When a 200 mesh screen is used the results are less satisfactory.

The particles of metal in the resistive film 10 are small. Exemplary such particles are about 1 micrometer in size.

Much less preferably, the metal is provided as a very thin conductive film but without glass included in the conductive film.

Proceeding to a description of the resistive film (such as 10) after the fault, this is determined by first removing the lid 19, epoxy 22 and overglaze 23. Examination by microscope of the resistive film (line) 10 thus exposed reveals the presence of many interruptions, breaks, or discontinuities in the resistive film (line) 10 and extending generally perpendicular to the longitudinal axis of the film (line). The number of such breaks is, applicant believes, related to the magnitude of the voltage present across the FCFR during continuance of the fault. The breaks are spaced from each other longitudinally of the film (line).

For example, in one FCFR of 10 ohm resistance, there were 63 breaks in 0.68 inch of film (line) 10, when the voltage present during the fault was 1000 volts. Higher voltage would produce more breaks; less-high voltage would result in less breaks.

Typically, each such break (interruption or discontinuity) is about 0.0005 inch to 0.003 inch wide. These breaks are usually not empty; they contain some residue and also some metal balls or spheres. They also contain some glass, which may be dissolved out by acid in order that the metal may be better seen.

The breaks may present the appearance of aerial photos of large rivers, in which there are islands and channels-the "river" edges (banks) being not straight but irregular. The "rivers" extend substantially the entire distance (0.030 inch in the above-stated example) across the resistive element (such as resistive line 10). The metal balls give the appearance, from above, of very large balloons that are hovering over the "rivers"-typically at their "banks". The balls have a variety of sizes.

The breaks (or series thereof) give the appearance of having been produced by pulling the resistive film or line apart, by tensile forces that are longitudinal to the line.

Applicant has several theories to explain the stated phenomena. But despite (for example) examinations of the parts using an electron microscopes, most "explanations" are in large part speculations. There are some things that appear quite evident:

(1) Some metal in the breaks becomes molten, because it draws up into the balls or spheres (probably by surface tension).

(2) As above stated, the higher the voltage the greater the number of breaks. The multi-break fault condition is to be sharply contrasted with what occurs in conventional all-metal (wire, or metal section) fuses. There, there is typically only one break, and it becomes larger and larger. It is not known whether the breaks in the present device occur simultaneously or in cascade.

(3) The close containment contains vapor resulting from heating of the conductive film, and/or may constrain molten metal as it tends to grow into larger balls. One or both of any such effects may tend to prevent or extinguish arcs or excessive break-growth.

(4) The flash of light appears to occur along a length of the fuse resistor-not only at one point.

(5) The fault current clears so fast that the containing structure does not explode or break.

(6) The fault current clears so fast that the top surface of the overglaze is not normally melted or affected (only sometimes slightly "freckled").

(7) The present phenomena are not the result of solution (dissolving) of the metal in the glass. Solution is not desired, though some may be tolerated.

(8) Because there are many breaks, the amount of voltage drop across each break is greatly reduced. There is something like a voltage-divider action.

(9) Any arcing is readily contained and extinguished.

(10) The preferred resistance range, stated above, provides the significant benefit of limiting the magnitude of the fault current just before clearing.

Embodiment of FIG. 8

Except as specifically stated, the embodiment of FIG. 8 is identical to that described above and exemplified below in the specific examples.

In this embodiment, the resistive line (film) 10 is usually not covered by the overglaze 23, although it may be so covered.

The lid 19 is not present, nor is the sealing and connecting material (epoxy) 22 present.

There is provided over the resistive line 10, after firing of such line, a chemically-bonded ceramic substance 26 having sufficient thickness that it will not blow out during a fault condition but will instead contain the pressure resulting from the heating and fusing caused by the high current.

As an example, the preferred form of the substance 26 may be about 0.03 inch thick. However, with some resistive line compositions the thickness is made 0.040 inch–0.060 inch, to prevent blowout.

Substance 26 is applied in paste form by a syringe and then allowed to air dry. It is then baked and cured. For example, it may (after air drying) be baked at 200° F. for 3 hours, then cured at 300° F. for one hour. It adheres very tightly to the substrate.

A preferred such ceramic substance 26 is "Cerama-Dip 538", which is a dielectric coating used for embedding high-temperature resistance wires, etc. Its major constituent is alumina. It is sold by Aremco Products, Inc., of Ossining N.Y.

Embodiment of FIGS. 9–14

One of the advantages of the present simple and economical FCFR is that it may be packaged in ways desired by the electronics industry. Thus, for example, it may be packaged as a heatsink-mount device, or a radial lead device, or an axial lead device, or a surface mount device. These devices may have standard physical sizes and footprints.

Parts in FIGS. 9–14 that correspond to those in FIGS. 1–8, are given the same reference numeral but followed by "a". The substrate 13*a* corresponds to substrate 13 except that it is vertically somewhat elongate. Low resistivity traces 14*a* and pads 16*a* are screen-printed thereon and then fired. Then, resistive film (line) 10*a* is screen-printed thereon and fired. Overglaze 23*a* is screen-printed there over and fired.

Then, leads or pins 28 are soldered to the pads 16*a*, and extend parallel to each other outwardly from the substrate 13*a*. Lid 19*a* (FIG. 13) is then applied by the containing and sealing material (epoxy). Or, ceramic (such as 26) is used.

Figure 13:
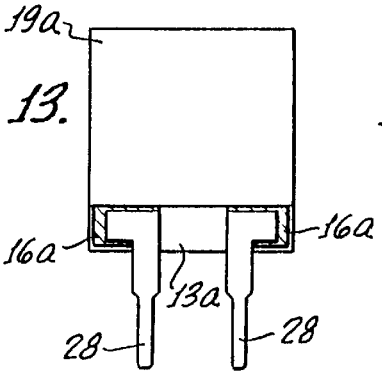
Figure 14:
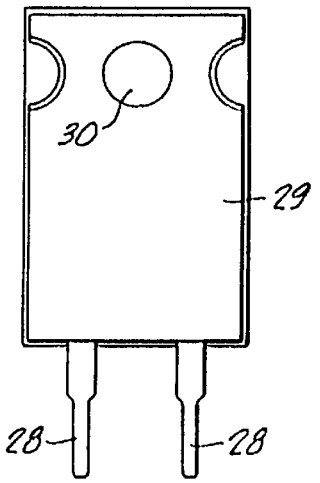

A molded package or body 29 (FIG. 14) of synthetic resin is then formed around the assembly shown in FIG. 13, by transfer molding or injection molding. The illustrated package 29 has a bolt hole 30 therethrough, so that the device is used as a heatsink-mount device.

Figure 15:
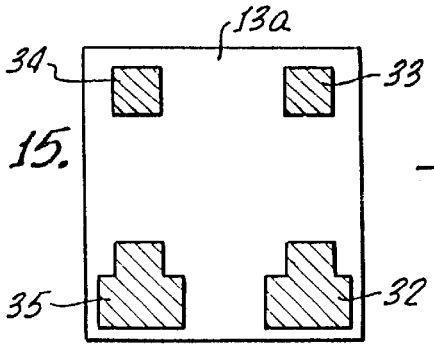
FIGS. 15–16 are front elevational views showing a further embodiment.
Figure 16:
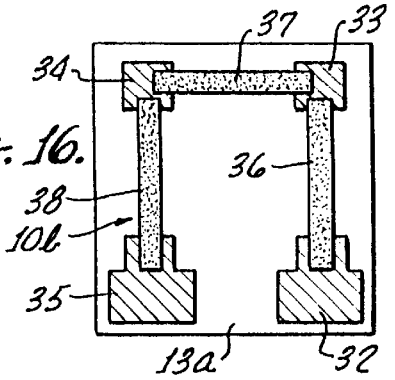

Embodiment of FIGS. 15–16

In accordance with the present embodiment, the resistive film (line) 10*b* corresponds to lines 10 and 10*a* in composition, etc., but is different in major ways. It is not continuous but segmented. The segments are connected together by low-resistivity pads corresponding in composition to pads (and traces) 14–16 and 14*a*–16*a*.

In the illustrated form there are four pads 32, 33, 34 and 35 at the corner portion of substrate 13*a* (which is the same as the substrate in the previous embodiment).

Sections 36, 37 and 38 of the resistive film (line) connect respectively between pads 32–33, 33–34, and 34–35. Except for length and orientation, sections 36, 37 and 38 are each identical to resistive film 10.

The illustrated sections 36, 37 and 38 are at right angles to each other. Their combined lengths are much longer than (for example) the length of line 10*a* in FIG. 10. Accordingly, the embodiment of FIGS. 15–16 can withstand a higher voltage, after the fault condition ends, than can the embodiment of FIGS. 9–14. The fault voltage drop is distributed along the film line-more specifically along the breaks in such line-so that the longer line provides better isolation of higher fault voltages.

The low-resistivity corner pads 33,34 reduce the chances that there will be arcing at the corners, or that there will be undesirably large breaks at the corners. No large break is desired; what are wanted are a multiplicity of small breaks such as were described relative to the first embodiment.

The device of FIGS. 15–16 is completed by following the steps shown and described relative to FIGS. 11, 12, 13 and 14. The result is a high-voltage FCFR, that is small and shaped and packaged as desired, that clears at high currents with amazing speed.

There is hereby incorporated herein by reference, as though set forth in full, the enclosed 11-page appendix entitled "Additional Specific Examples".

The word "glass" as used in the appended claims includes not only the conventional meaning of that word, but also any ceramic substances having a capability of forming during firing a glass-like matrix in the conductive film, which glass-like matrix functions equivalently to glass so as to achieve the multiple breaks described in detail above. It is also to be understood that under some conditions glass may be "made" during firing from glass-forming ingredients in the deposited material. The glass material may contain reinforcing fillers. The word "metal", as used in the appended claims, may include also some conductive metal oxides employed together with the metallic metal.

The foregoing detailed description is to be clearly understood as given by way of illustration and example only, the spirit and scope of this invention being limited solely by the appended claims.

What is claimed is:

1. A method of discontinuing flow of an electrical fault current in a very short time, said method comprising:

(a) providing an elongate element on a substrate, said elongate element being electrically conductive, (b) selecting and constructing said element that when a high fault current is suddenly passed through said element, said element will very rapidly break not merely in one or a few places but in many places spaced along said element to thereby rapidly discontinue flow of said fault current, wherein said substrate remains intact unbroken, uncracked and unruptured as a result of said fault current, and (d) suddenly passing a high fault current through said element to thereby cause said many breaks spaced along said element and consequent rapid discontinuance of flow of said fault current, wherein said substrate remains intact, unbroken, uncracked and unruptured as result of said fault current.

2. The invention as claimed in claim 1, in which said fault current is generated by suddenly applying between opposite ends of said element a fault voltage in the range of about 150 volts to about 2,000 volts.

3. The invention as claimed in claim 2, in which said fault voltage is D.C. voltage.

4. The invention as claimed in claim 1, in which said fault current is in the range of about 15 amps to 500 amps.

5. The invention as claimed in claim 1, in which said method further comprises causing said element to have an electrical resistance in the range of 10 ohms down to about 0.5 ohm.

6. The invention as claimed in claim 1, in which said method further comprises causing said element to have an electrical resistance less than 30 ohms.

7. The invention as claimed in claim 6, in which said method further comprises constructing said element as a line that is narrow and thin and short.

8. The invention as claimed in claim 1, in which said method further comprises:

(a) providing a line of resistive film on said substrate, said line of resistive film being said elongate element, (b) providing a layer of glass on said line of film, (c) providing a back-up closely over said layer of glass to cooperate with said glass and said substrate to contain and seal said line of film, (d) so selecting the composition and shape and dimensions of said line of film that upon application of a high fault voltage across said line of film the resulting fault current through said line of film will extinguish so fast that at least the outer side of said layer of glass will not melt, and (e) applying said high fault voltage across said line of film.

9. A method of discontinuing flow of an electrical fault current in a circuit portion, said method comprising:

(a) connecting in circuit with said circuit portion a FCFR having a narrow line of fuse film on a substrate, which fuse film consists essentially of metal, (b) closely confining and sealing said resistive film to prevent escape of vapors at said fuse film when a fault occurs in said circuit portion, (c) selecting said film and effecting said containing and sealing that upon occurrence of said fault said fuse film will very rapidly break transversely thereof in a longitudinally spaced manner in many places to thereby rapidly discontinue flow of said fault current, characterized in that upon occurrence of said fault current there is a visible flash of light along a length of said fuse film not only at one point, and (d) suddenly passing a fault current through said fuse film to thereby cause said many breaks transversely thereof in a longitudinally spaced manner and consequent rapid discontinuance of flow of said fault current.

10. The invention as claimed in claim 9, in which said fault current ceases extremely rapidly without there being substantial dissolving of said metal in any substance adjacent to said metal.

11. The invention as claimed in claim 9, in which said fuse film is a resistive film.

12. The invention as claimed in claim 9, in which said method further comprises:

(a) providing a first terminal trace and a second terminal trace, and (b) electrically connecting said first terminal trace to a first end of said fuse film and electrically connecting said second terminal trace to a second end of said fuse film, wherein said first terminal trace and said second terminal trace remain intact as result of said fault current.

* * * * *